US010815094B2

(12) United States Patent
Zhao et al.

(10) Patent No.: US 10,815,094 B2
(45) Date of Patent: Oct. 27, 2020

(54) MECHANICAL PACKING CONVERSION APPARATUS INTEGRATING PACKAGING, MEASURING, CUTTING AND PROTECTING FUNCTIONS

(71) Applicant: ENVIRONMENTAL GASKET COMPANY, LTD., Nanjing, Jiangsu (CN)

(72) Inventors: Jingwei Zhao, Jiangsu (CN); Jun Zhang, Jiangsu (CN)

(73) Assignee: ENVIRONMENTAL GASKET COMPANY, LTD., Nanjing, Jiangsu (CN)

( * ) Notice: Subject to any disclaimer, the term of this patent is extended or adjusted under 35 U.S.C. 154(b) by 0 days.

(21) Appl. No.: 15/568,182

(22) PCT Filed: Aug. 26, 2015

(86) PCT No.: PCT/CN2015/088090
§ 371 (c)(1),
(2) Date: Oct. 20, 2017

(87) PCT Pub. No.: WO2016/169175
PCT Pub. Date: Oct. 27, 2016

(65) Prior Publication Data

US 2018/0086588 A1 Mar. 29, 2018

(30) Foreign Application Priority Data

Apr. 21, 2015 (CN) ..... 2015 1 0191892

(51) Int. Cl.
*B65H 35/06* (2006.01)
*B65H 61/00* (2006.01)
(Continued)

(52) U.S. Cl.
CPC ..... *B65H 35/06* (2013.01); *B65H 16/005* (2013.01); *B65H 35/0066* (2013.01);
(Continued)

(58) Field of Classification Search
CPC .. B65H 35/06; B65H 35/0066; B65H 49/322; B65H 49/08; B65H 16/005; B65H 57/18;
(Continued)

(56) References Cited

U.S. PATENT DOCUMENTS 1,681,739 A * 8/1928 McLaughlin ..... B41B 11/00 83/468
2,566,733 A * 9/1951 Krueger ..... B65H 35/0066 225/23
(Continued)

FOREIGN PATENT DOCUMENTS

CN 2778768 Y 5/2006
CN 203887889 U 10/2014
(Continued)

*Primary Examiner* — Jonathan G Riley
(74) *Attorney, Agent, or Firm* — Grogan, Tuccillo & Vanderleeden, LLP

(57) ABSTRACT

The present invention provides a mechanical packing conversion apparatus integrating packaging, measuring, cutting and protecting functions, comprising a box, a measuring scale and a cutting mechanism. An upper cover of the box of the apparatus and a side plate connected to the upper cover can be overturned and opened from side faces, and the cutting mechanism is disposed on a sidewall in the box; the cutting mechanism comprises a head and a base, the head being fixed to the base, a handle, a transmission member and a blade all successively connected being disposed in the head; a through hole is formed at a bottom end of the head, and the blade is placed vertically above the through hole and is communicated with the through hole; a groove configured to receive the measuring scale is provided at a bottom end
(Continued)

of the base; and the measuring scale is fixed to the bottom inside the box.

9 Claims, 4 Drawing Sheets

(51) Int. Cl.

| | |
|---|---|
| ***B65H 75/32*** | (2006.01) |
| ***B65H 49/32*** | (2006.01) |
| ***B65H 35/00*** | (2006.01) |
| ***B65H 16/00*** | (2006.01) |
| ***B65H 49/08*** | (2006.01) |
| ***B65H 57/18*** | (2006.01) |

(52) U.S. Cl.
CPC ..... *B65H 49/08* (2013.01); *B65H 49/322* (2013.01); *B65H 57/18* (2013.01); *B65H 61/00* (2013.01); *B65H 75/32* (2013.01); *B65H 2402/412* (2013.01); *B65H 2407/22* (2013.01); *B65H 2511/11* (2013.01); *B65H 2701/35* (2013.01); *B65H 2701/37* (2013.01)

(58) Field of Classification Search
CPC .... B65H 75/32; B65H 61/00; B65H 2511/11; B65H 2407/22; B65H 2402/412; B65H 2701/35; B65H 2701/37
See application file for complete search history.

(56) References Cited

U.S. PATENT DOCUMENTS

| | | | | | |
|---|---|---|---|---|---|
| 2,889,975 | A * | 6/1959 | Hanlon | B65H 35/0026 | 225/19 |
| 2,924,365 | A * | 2/1960 | Dahlquist | B65H 35/0026 | 225/47 |
| 2,988,944 | A * | 6/1961 | Bevier | B65H 35/0066 | 83/233 |
| 3,176,572 | A * | 4/1965 | Comet | B65H 35/0026 | 83/649 |
| 3,466,963 | A * | 9/1969 | Hawes | B65H 35/0026 | 225/16 |
| 3,611,576 | A * | 10/1971 | Quenot | G01B 3/1056 | 33/770 |
| 4,168,778 | A * | 9/1979 | Buxton | B65D 85/676 | 206/397 |
| 4,372,472 | A * | 2/1983 | Herrmann | B65H 35/0026 | 225/25 |
| 4,978,085 | A * | 12/1990 | Letourneau | B65H 49/24 | 242/588.3 |
| 5,326,421 | A * | 7/1994 | Taylor | B65H 35/0033 | 156/526 |
| 5,538,170 | A * | 7/1996 | Van Luit | B65H 35/002 | 225/47 |
| 7,320,351 | B2 * | 1/2008 | Chern | B65H 35/0033 | 156/523 |
| 8,656,976 | B2 * | 2/2014 | Hu | B65H 35/0033 | 156/270 |
| 8,875,769 | B2 * | 11/2014 | Walker | B29C 65/5092 | 156/523 |
| 2002/0185877 | A1 * | 12/2002 | Brunson | G01B 3/1071 | 294/65.5 |
| 2007/0295847 | A1 * | 12/2007 | Weck | B65H 49/322 | 242/170 |
| 2011/0179662 | A1 * | 7/2011 | Donovan | B25B 5/06 | 33/758 |
| 2013/0037206 | A1 * | 2/2013 | Hagglund | B65H 35/0033 | 156/250 |
| 2016/0221203 | A1 * | 8/2016 | Crispel | B26D 5/10 | |

FOREIGN PATENT DOCUMENTS

| | | | |
|---|---|---|---|
| CN | 203938292 | U | 11/2014 |
| CN | 104192645 | A | 12/2014 |
| CN | 104816985 | A | 8/2015 |
| JP | S57165644 | U1 | 10/1982 |
| JP | 2004-336943 | * | 4/2004 |
| JP | 2014044185 | A | 3/2014 |

* cited by examiner

MECHANICAL PACKING CONVERSION APPARATUS INTEGRATING PACKAGING, MEASURING, CUTTING AND PROTECTING FUNCTIONS

TECHNICAL FIELD OF THE INVENTION

The present invention belongs to the technical field of packaging and conversion, and particularly relates to a mechanical packing conversion apparatus integrating packaging, measuring, cutting and protecting functions.

BACKGROUND OF THE INVENTION

The conventional packaging of a mechanical packing is to reel the product into a ring or wind it onto a spool and then put it into a carton, a plastic box or a wooden box for transportation. The packaging box itself has a transportation function, without any measuring and cutting functions. To use the product, it is necessary to take the mechanical packing out of the packaging box, in a separate process measure a length to be cut, and then cut or shear the mechanical packing off with a knife. As a result, the whole process is discontinuous, scattered, and leads to multiple time consuming steps which affect maintenance department operating efficiency. Furthermore, due to the lack of protection during the cutting operation, personnel injury often happens. This scattered, multiple step approach to converting bulk mechanical packing to a usable unit (rings of appropriate length), may cause maintenance or repair operations on a production site, especially during plant shutdown or outage periods, to incur costly delays and additional labor costs simply because of this tedious process or because of the misplacement of measuring or cutting tools. Consequently, unnecessary economic loss is caused. These problems are common and still often occur at present.

SUMMARY OF THE INVENTION

To overcome the above deficiencies in the prior art, the present invention provides a mechanical packing conversion apparatus integrating packaging, measuring, cutting and protecting functions, which effectively solves the problem of unitary function of the conventional mechanical packing packaging boxes and also handles the issues of scattered measuring and cutting operations, personnel safety protection during cutting and protection against damage and degradation of the material to be cut.

To achieve these purposes, the present invention employs the following technical solutions.

A mechanical packing conversion apparatus integrating packaging, measuring, cutting and protecting functions, comprising a box, a measuring scale and a cutting mechanism; an upper cover of the box and a side plate connected to the upper cover which can be opened from side faces, and the cutting mechanism is disposed on a sidewall in the box; the cutting mechanism comprises a head and a base, the head being fixed to the base, a handle, a transmission member and a blade all successively connected being disposed in the head; a through hole is formed at a bottom end of the head, and the blade is placed vertically above the through hole and is communicated with the through hole; a groove configured to receive the measuring scale is provided at a bottom end of the base; and the measuring scale is fixed to the bottom inside the box.

A mechanical packing clamping mechanism is provided at the end of the measuring scale which can extend and retract.

The box is fully enclosed; and a tongue is provided on either side of the side plate which can be overturned and opened, and the tongues can be inserted into two corresponding sidewalls of the box.

Further, a hand grip is provided on the outside upper cover of the box.

The packaging apparatus has an I-shaped packing reel disposed therein, and a protective pad and a rigid plate are provided at the joint of the base and the through hole.

Preferably, the transmission member of the cutting mechanism comprises a screw stem and a thread sleeve; one end of the screw stem is connected to the handle; the thread sleeve is sheathed on the screw stem; and the blade is fixed to the thread sleeve.

Further, the thread sleeve can do circular rotation.

Preferably, the transmission member of the cutting mechanism comprises a connecting rod, a blade holder, a spring and guide rods; two ends of the connecting rod are respectively connected to the handle and the blade holder; the blade is fixed to the blade holder; the spring is sheathed outside the connecting rod and the blade holder and clamped to a spring limiting step disposed inside the head; and the guide rods are disposed on two sides of the cutting mechanism and connected to the head and the base.

The mechanical packing conversion apparatus of the present invention is capable of effectively improving the packaging and transportation functions, has various functions such as convenience in transportation and carrying, accurate measuring and cutting, cutting safety protection, and can be repeatedly used, especially for maintenance and repair in a production site. The apparatus can not only greatly protect the personnel safety, reduce the material consumption, improve the production efficiency and shorten downtime for maintenance, but also reduce the consumption, protect the environment and increase the economic benefits.

DETAILED DESCRIPTION OF THE INVENTION

The present invention will be further described below with reference to the accompanying drawings and by embodiments.

Embodiment 1

Figure 1:
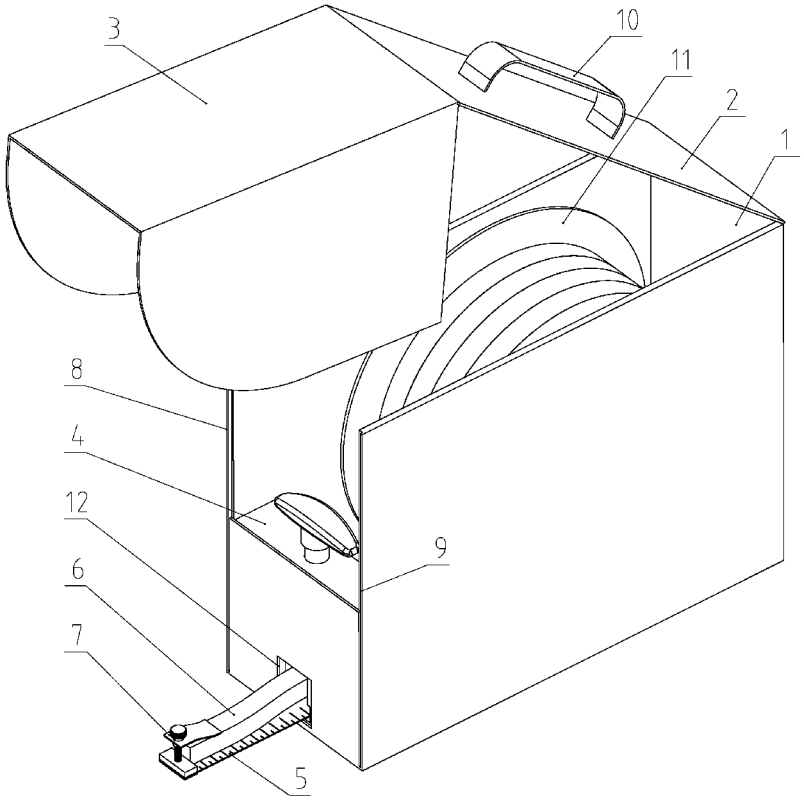
FIG. 1 is a structure diagram of Embodiment 1 of the present invention.
Figure 2:
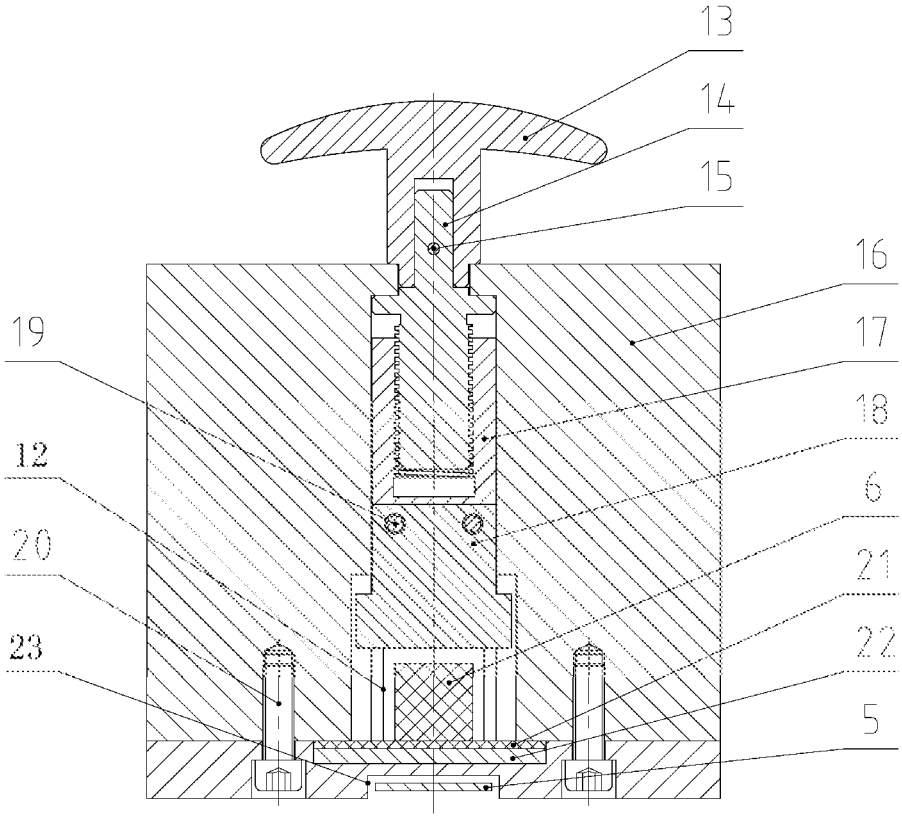
FIG. 2 is a cross-sectional diagram of Embodiment 1 of the present invention.

As shown in FIG. 1 and FIG. 2, the mechanical packing conversion apparatus integrating packaging, measuring, cutting and protecting functions of the embodiment is an overall box structure, comprising a box 1, a measuring scale 5 and a cutting mechanism 4; an upper cover 2 of the box and a side plate 3 connected to the upper cover which can be overturned and opened from side faces, and the cutting mechanism 4 which is disposed on a sidewall of an overturning opening in the box 1; a through hole 12 is formed at a bottom end of the cutting mechanism 4; and a mechanical packing 6 wound onto a reel is placed inside the box 1. When in use, the mechanical packing 6 passes through the cutting mechanism 4 via the through hole 12 and out from the sidewall of the box 1, and is then accurately cut after being pulled outward for length measurement. Wherein, the measuring scale 5 is fixed to the bottom inside the box 1, and the measuring scale 5 can extend and retract and protect the packing 6 to be cut. A groove 23, by which the measuring scale 5 goes out from the box 1, is provided on a bottom end of the base of the cutting mechanism 4. A packing clamping mechanism 7 is provided at the scale end of the measuring scale 5 for fixing the packing so that the packing can be cut conveniently.

The cutting mechanism 4 comprises a head and a base, which are fixedly connected by a fastener 20. The head comprises a handle 13, a transmission member (i.e., screw stem) 14, a thread sleeve 17 and a blade 18, wherein the screw stem 14, the thread sleeve 17 and the blade 18 are disposed inside the head and successively and fixedly connected by fastening screws 14 and 19; and the handle 13 is located outside the head. The blade 18 is placed vertically above the through hole 12 and is communicated with the through hole 12; a protective pad 21 and a rigid plate 22 are provided on the base at a position corresponding to the joint of the head and the through hole 12. The handle 13 is rotated while being pressed by the transmission member, so that the blade 18 passes through the through hole 12 to do cutting motion. The thread sleeve 17 can do circular rotation for the purpose of adjustment. By the thread sleeve 17, it is convenient to adjust the cutting angle to obtain different cutting cross-sections in order to meet different cutting requirements.

The box 1 provides for fully-enclosed protection; a tongue is provided on either side of the side plate 3, and the tongues can be inserted into two sidewalls 8 and 9 of the box, which are adjacent and corresponding to each other; and a hand grip 10 is further provided outside the upper cover 2 of the box, which is convenient for carrying and transportation. The reel 11 for the packing 6 is I-shaped.

In addition, by changing the shape of the blade 18, the cutting path may be caused to be a linear line, a broken line, a curved line or a combination of any two of the above lines, in order to meet the requirements of more users.

Embodiment 2

Figure 3:
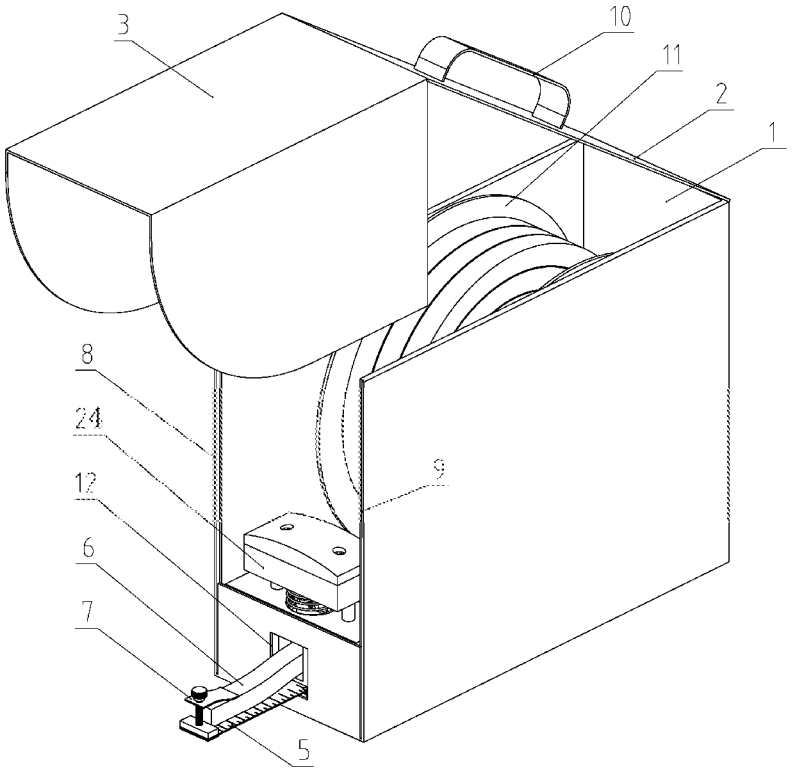
FIG. 3 is a structure diagram of Embodiment 2 of the present invention.
Figure 4:
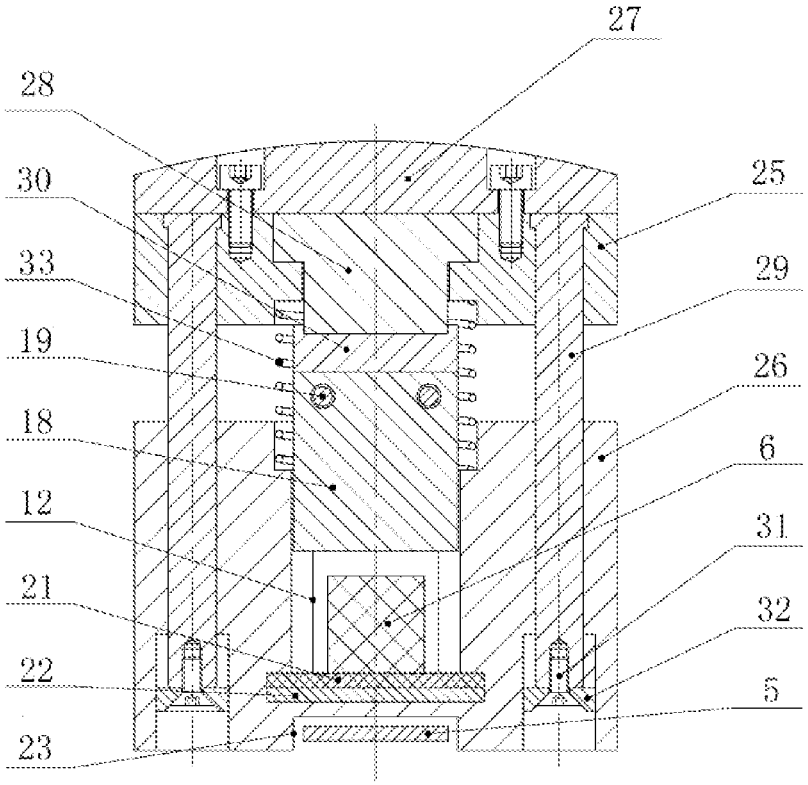
FIG. 4 is a cross-sectional diagram of Embodiment 2 of the present invention.

As shown in FIG. 3 and FIG. 4, a mechanical packing conversion apparatus integrating packaging, measuring, cutting and protecting functions of the embodiment is similar to that of Embodiment 1. The difference lies in that the cutting mechanism used has a different structure.

The cutting mechanism 24 comprises a head 25 and a base 26; and the head 25 comprises a handle 27, a connecting rod 28, a blade holder 30, a blade 18, a spring 34 and guide rods 29. Wherein, the handle 27, the connecting rod 28, the blade holder 30 and the blade 1 are successively and fixedly connected by fastening screws. The spring 34 is sheathed outside the connecting rod 28 and the blade holder 30 and clamped to a spring limiting step disposed inside the head 25. The guide rods 29 are disposed on two sides of the cutting mechanism 24 and connected to the head 25 and the base 26, for cooperating with the up-down motion of the head 25. The handle 27 is rotated while being pressed by the transmission member, so that the blade 18 passes through the through hole 12 to do cutting motion.

The invention claimed is:

1. A mechanical packing conversion apparatus for removably accommodating a spooled work piece comprising a box, a measuring scale, and a cutting mechanism disposed inside the box, wherein the box has a bottom, two opposite sidewalls connected to the bottom, an upper cover, and a side plate;

wherein the side plate is connected only to the upper cover so that the upper cover and the side plate are configured to open together when lifted;

wherein the cutting mechanism comprises a head affixed to a base;

wherein the head comprises a handle, a transmission member, and a blade successively connected, and a through hole disposed at a bottom end of the head and configured to receive a packing tape, and wherein the blade is movably placed in a vertical direction perpendicular to an opening of the through hole;

wherein the base has a groove configured to receive the measuring scale;

wherein the measuring scale is affixed to the bottom inside the box and is retractable into and extendable outside the box;

an adjustment mechanism for selectively adjusting an angle of said head of said cutting mechanism; and a clamping mechanism fixed to a distal end of said measuring scale, said clamping mechanism being releasably attachable to a distal end of said spooled work piece such that movement of said measuring scale in and out of said box causes said spooled work piece to also move a corresponding distance in and out of said box when said clamping mechanism is attached to said distal end of said spooled work piece.

2. The mechanical packing apparatus according to claim 1, wherein, the side plate has two tongues, when then box is closed, the two tongues inserted into the box.

3. The mechanical packing conversion apparatus according to claim 1, wherein a hand grip is installed on the upper cover on the outside of the box.

4. The mechanical packing conversion apparatus according to claim 1, wherein the converting apparatus has a mechanical packing reel disposed inside the box, and a protective pad and a rigid plate are provided at a joint of the base and the through hole.

5. The mechanical packing conversion apparatus according to claim 1, wherein the transmission member of the cutting mechanism comprises a screw stem and a thread sleeve; one end of the screw stem is connected to the handle; the thread sleeve is sheathed on the screw stem; and the blade is fixed to the thread sleeve.

6. The mechanical packing conversion apparatus according to claim 1, wherein the transmission member of the cutting mechanism comprises a screw stem and a thread sleeve; one end of the screw stem is connected to the handle; the thread sleeve is sheathed on the screw stem; and the blade is fixed to the thread sleeve.

7. The mechanical packing conversion apparatus according to claim 2, wherein the transmission member of the cutting mechanism comprises a screw stem and a thread sleeve; one end of the screw stem is connected to the handle; the thread sleeve is sheathed on the screw stem; and the blade is fixed to the thread sleeve.

8. The mechanical packing conversion apparatus according to claim 3, wherein the transmission member of the cutting mechanism comprises a screw stem and a thread sleeve; one end of the screw stem is connected to the handle;

the thread sleeve is sheathed on the screw stem; and the blade is fixed to the thread sleeve.

9. The mechanical packing conversion apparatus according to claim 4, wherein the transmission member of the cutting mechanism comprises a screw stem and a thread sleeve; one end of the screw stem is connected to the handle; the thread sleeve is sheathed on the screw stem; and the blade is fixed to the thread sleeve.

* * * * *